US006247594B1

(12) United States Patent
Garton

(10) Patent No.: US 6,247,594 B1
(45) Date of Patent: Jun. 19, 2001

(54) FLUID TANK ASSEMBLY

(75) Inventor: Darwin Garton, Malcolm, NE (US)

(73) Assignee: Snyder Industries, Inc., Lincoln, NE (US)

( * ) Notice: Subject to any disclaimer, the term of this patent is extended or adjusted under 35 U.S.C. 154(b) by 0 days.

(21) Appl. No.: 09/655,464

(22) Filed: Aug. 31, 2000

(51) Int. Cl.[7] ..... B65D 21/032

(52) U.S. Cl. ..... 206/512; 220/1.5; 220/23.91; 220/668

(58) Field of Search ..... 220/562, 1.5, 647, 220/668, 23.91, 23.89, 918, 919, 920; 206/512

(56) References Cited

U.S. PATENT DOCUMENTS 3,129,836 * 4/1964 Frevel ..... 220/920
4,398,653 * 8/1983 Daloisio ..... 222/143
4,728,000 * 3/1988 Gerhard ..... 220/647
5,490,603 2/1996 Davis .
5,655,662 * 8/1997 Garcia ..... 206/583
5,687,874 * 11/1997 Omori et al. ..... 220/737
5,779,077 * 7/1998 Fossey ..... 220/1.5
6,142,327 * 11/2000 Riggio et al. ..... 220/1.5

* cited by examiner

*Primary Examiner*—Stephen Castellano
(74) *Attorney, Agent, or Firm*—Hovey, Williams, Timmons & Collins

(57) ABSTRACT

A fluid tank assembly is designed for stacking with similar assemblies. The fluid tank assembly includes a base having a plurality of upright stacking legs, a tank having a liquid-receiving chamber received on and supported by the base, and couplers for connecting the tank to the stacking legs adjacent the upper ends of the latter. The couplers away be provided as fasteners such as bolts and receivers whereby the tank prevents the legs from spreading outwardly. Alternatively, the couplers may be provided as bosses molded into the tank which interfit with corresponding slots on the stacking legs. The tank is preferably permitted to shift relative to the base to accommodate movement during filling and emptying and shifting during transport. The couplers avoid the necessity of separate protective tops or other structure which joins the tops of the legs together, but rather uses the tank as a structural component without imparting significant vertical loads thereto.

25 Claims, 2 Drawing Sheets

FLUID TANK ASSEMBLY

BACKGROUND OF THE INVENTION

1. Field of the Invention

This invention concerns a fluid tank assembly including a tank and a tank frame which elevates and protects the tank. More particularly, it concerns an economical and stackable bulk fluid tank assembly.

2. Description of the Prior Art

Portable liquid tanks are extremely useful in transporting chemicals from a manufacturer or distributor to an end user and then dispensing the contents thereof. Such portable tanks were once traditionally made of metal and housed in metal cages. The cages both protected the tanks and permitted stacking of two or more tanks to improve floor space utilization. However, the corrosive nature of such chemicals and the cost attributable to both the metal tanks and the metal cages led to a need to develop fluid tank assemblies less susceptible to corrosion and lower in cost, while still retaining the advantages of durability and stackability.

Among the different approaches to meeting the need for an improved fluid tank assembly is that found in U.S. Pat. No. 5,490,603 to Davis, the disclosure of which is incorporated by reference. The 5,490,603 patent discloses a fluid tank apparatus substantially of synthetic resin and including a base, a fluid tank supported thereon, and a protective cover. The base includes a bottom wall and a plurality of upstanding columns so that compressive loads exerted on the top cover are transmitted through the columns to the base rather than through the tank. The base and its upstanding columns thus interfit with the top protector to permit stacking of further assemblies thereon and protect the tank received therein.

While the fluid tank assembly of the 5,490,603 patent represents a substantial improvement over the prior art, there has developed a need for a fluid tank assembly having comparable or equivalent storage capacity and similar stackability with reduced manufacturing costs. Such a fluid tank assembly would most preferably remain primarily constructed of primarily of synthetic resin for corrosion resistance and moldability, without sacrificing the ability to somewhat protect the tank against minor impact. Finally, the need remains to avoid transmission of substantial loads to the tank itself when stacked.

SUMMARY OF THE INVENTION

These and other objects have largely been met by the fluid tank apparatus of the present invention. That is to say, by designing the tank assembly to more fully incorporate the tank as a structural member in accordance with the present invention, the fluid tank assembly hereof is designed to improve material utilization, retain stacking capability and capacity without imparting substantial loading to the tank, provide protection against side impact around the corners of the assembly, and retain resistance to corrosive chemicals.

Broadly speaking, the present invention eliminates the need for a separate protective cover and includes a base having a multiplicity of upright stacking legs, a tank which is configured for receipt on the base, and coupling means for inhibiting the tops of the stacking legs from spreading. The tank is coupled to the stacking legs to prevent the legs from spreading when a load is applied thereabove. Because the stacking legs extending upwardly from the base is nearly vertical, even heavy loads applied to the stacking legs result in only a small horizontal force which must be resisted by the tank. The tops of the stacking legs extend above the tank itself and are complementally configured to mate with the bottom of a base placed thereon. In this manner, the tank is securely held by the base, loads applied on the stacking legs are substantially isolated from the tank, and the need for a separate cover is substantially eliminated.

The coupling of the stacking legs to the tank may be accomplished in several ways. An receiver may be molded as a part of or integrated into either the tank or the stacking leg, with the other being provided with an opening such as a vertical slot for the passage of a fastener therethrough. The receiver may be internally threaded whereby the fastener may be provided as a threaded member such as a bolt for coupling to the receiver. Thus, the fastener, oriented horizontally, passes through the opening and abuts a wall surface to thereby inhibit relative horizontal movement between the stacking leg and tank while being free to shift vertically within the opening. Alternatively, the receiver may be molded into the stacking leg as a vertical slot with shoulders, and the fastener provided as a complementally configured generally horizontally extending boss on the tank for receipt within the slot. In this way, the legs are inhibited from horizontal movement relative to the tank by the interconnection between the fastener and the receiver molded as parts of the tank and stacking leg.

These and other advantages will be readily appreciated by those skilled in the art with reference to the description and drawings which follow.

DESCRIPTION OF THE PREFERRED EMBODIMENT

Figure 3:
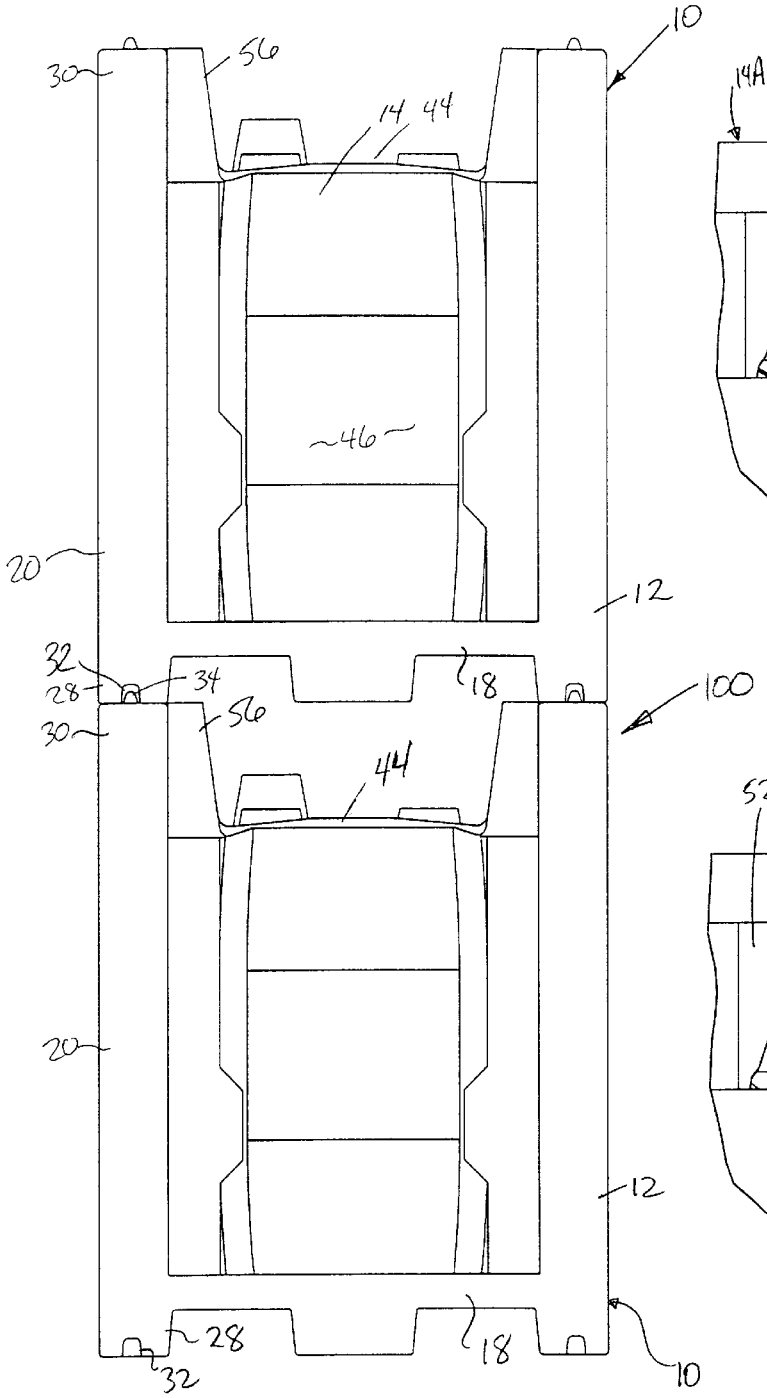
FIG. 3 is a front elevational view of two tank assemblies as shown in FIGS. 1 and 2 in stacked relationship, with the receptacles at the lower end of the stacking legs for receipt of the stacking lugs at the top of the stacking legs shown in dotted lines.

Referring now to the drawing, a fluid tank assembly 10 in accordance with the present invention broadly includes a base 12, a tank 14, and couplers 16 for securing the tank 14 to the base 12. As shown in FIG. 3, the assemblies 10 may be stacked one atop the other with the base 12 ofthe upper assembly 10 elevated above the tank 14 of the lower assembly 10. The base 12 and tank 14 are primarily rotationally molded of thermoplastic synthetic resin such as high density polyethylene for good corrosion resistance, durability, and economy of manufacture.

In greater detail, the base 12 broadly includes a platform 18 and a plurality of upright stacking legs 20 which are integrally rotationally molded with the platform 18. As illustrated, the platform 18 is substantially rectangular in configuration presenting four comers, each comer having a stacking leg extending upwardly therefrom. However, it may be appreciated that the platform 18 may be circular, polygonal, ribbed or any other shape or configuration sufficient to support the tank 14 thereon, with the stacking legs positioned substantially equally therearound. In order to provide stability, at least two and preferably at least three such stacking legs 20 are necessary. The platform 18 is preferably a hollow, substantially rectangular wall which includes a sump passage 22 and a plurality of secondary passages 24. The passages extend through the platform and because of the side surfaces 26 formed thereon, strengthen the platform 18 and serve to maintain distancing between the upper and lower platform wall surfaces across the platform.

Figure 1:
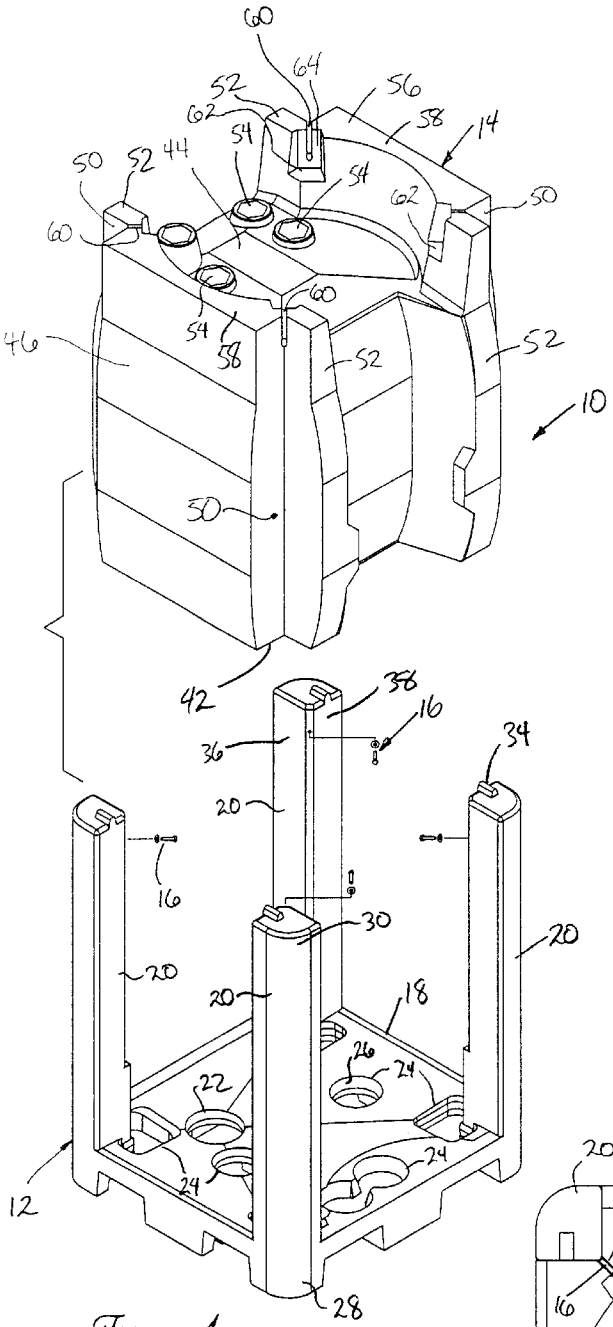
FIG. 1 is an exploded, perspective view of the fluid tank assembly of the present invention, showing the couplers used to connect the tank to the stacking legs of the base.
Figure 4:
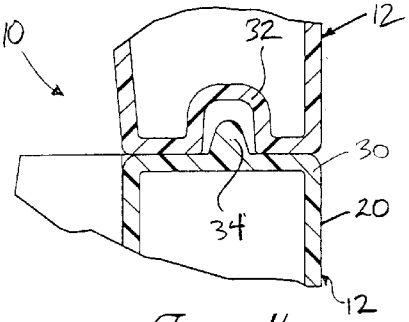
FIG. 4 is an enlarged, vertical cross-sectional view of the top of one stacking leg interfitting with the bottom of another stacking leg superposed thereon.

The upright stacking legs 20 have a bottom end 28 extending below and joining with the platform 18 and a top end 30. Receptacles 32 are molded as indentations into the bottom end 28 and stacking lugs 34 molded into the top of the top end 30 are complementally configured for entry into the receptacles 32 as shown in FIG. 4. As shown in detail in FIGS. 2 and 5, the stacking legs 20 are substantially hollow and have substantially flat walls 36 and 38 perpendicularly angled relative to one another and outer wall 40 which is shown to be arcuate but may be of another configuration if desired.

Figure 2:
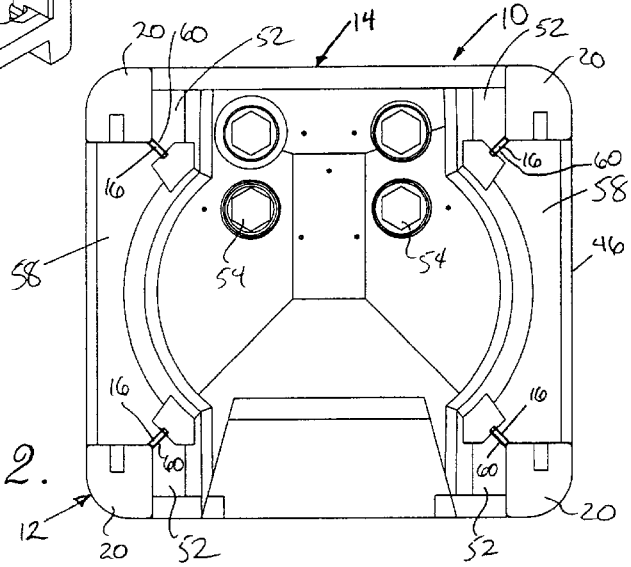
FIG. 2 is a top plan view of the fluid tank assembly of FIG. 1, showing the spacing of the stacking legs around the tank.

The tank 14 as shown in FIGS. 1 through 5 is hollow, having a bottom wall 42, a top wall 44 and a side wall 46 defining a fluid-receiving chamber 48 therein. Recesses 50 extend in an upright direction at selected intervals around the side wall 46 and are located at the comers of the tank 14 as shown herein. The tank 14 includes opposed pairs of upright buttresses 52 which are formed in the side wall 46 and serve to define the elongate recesses 50. The tank includes a sump extending downwardly from the bottom wall 42 and which is received in the sump passage 22. A plurality of bung openings and removable bung caps 54 are located in the top wall 44 into which a pump may be mounted. A pump protector 56 including opposite hollow rims 58 is also molded as a part of the tank 14 and extends generally above the top wall. The rims 58 extend upwardly essentially the same height as buttresses 52 and laterally between oppositely extending buttresses 52. An opening provided as a vertical slot 60 is located at the intersection of each buttress 52 and its adjacent rim and is diagonally oriented as shown in FIG. 2 so as to extend generally toward the middle of the tank 14 viewed in plan and acutely angled relative to both flat walls 36 and 38. The slots 60 connect the recesses 50 with an inboard indentation 62 which includes a riser 64 formed in the buttresses 52 and rims 58, the riser 64 being both upright and generally perpendicular to the slot 60.

Figure 5:
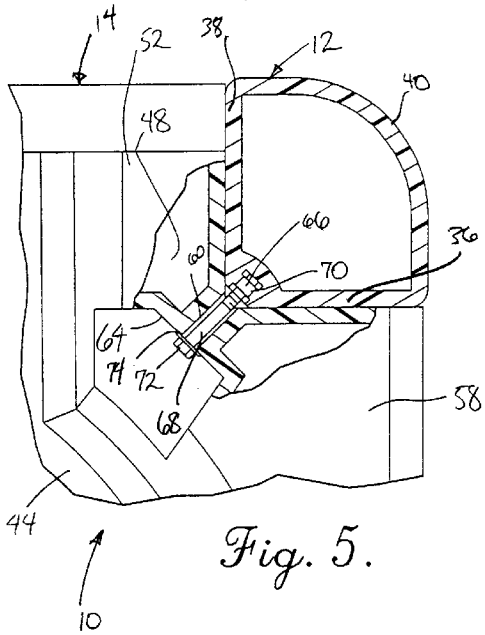
FIG. 5 is an enlarged, fragmentary vertical plan view in partial horizontal cross-section showing the coupler as a fastener threaded into a receiver provided as a molded insert of one stacking leg for securing the stacking leg against spreading.

The couplers 16 may be provided separate from the base 12 and tank 14 or incorporated therein. As shown in FIG. 5, the couplers 16 include a receiver 66 and a fastener 68 for interconnecting the stacking legs 20 to the tank 14. The receiver 66 of FIG. 5 includes an insert 70 which is molded into the stacking legs 20 adjacent the top end 30 thereof, the insert 70 being oriented in alignment with the slot 60. By such alignment, fastener 68, such as a bolt 72 may be threaded into the inserts shown in FIGS. 1 and 5, and washer 74 abuts the riser 64 and helps in inhibiting the passage of the bolt head through the slot 60. The bolt 72 receives the washer 74 thereon, the bolt 72 being threaded into the insert 70, and the washer 74 then engaging riser 64 to permit retention of the stacking leg 20 in an upright position when loads are placed thereon. The insert 70, bolt 72 and washer 74 are typically of metal, which may be stainless steel if improved corrosion resistance is desired, or even synthetic resin if it is desired that no metal be used, because only limited horizontal force is necessary to maintain the stacking legs 20 in an upright orientation. Moreover, the slot 60 enables the bolt 72 to move up and down therealong to avoid transmission of significant compressive loads to the tank 14, as the tank 14 is thus permitted to shift vertically relative to the stacking legs 20.

Figure 6:
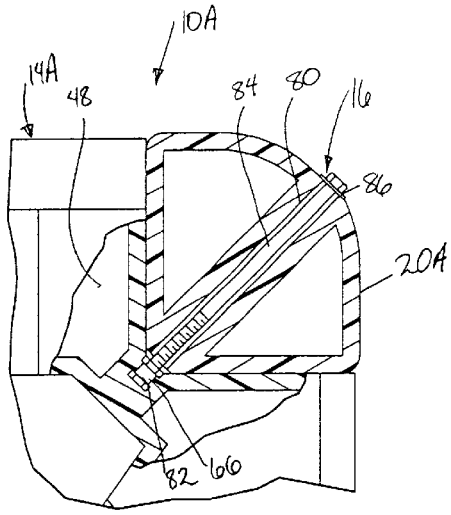
FIG. 6 is an enlarged, fragmentary vertical plan view in partial horizontal cross-section showing an alternate embodiment of the present invention wherein the receiver is provided as a molded insert in the tank and the coupler is a fastener extending through a slot in the stacking leg.

As shown in FIG. 6, an alternate embodiment 10A of the assembly is provided which is fundamentally the same as that shown in FIG. 5, but wherein a vertical slot 80 open at the top is provided in the upper end of a modified stacking leg 20A. Moreover, the receiver 66 of the coupler 16 is provided as an insert 82 molded into the tank 14A at the junction of each rim 58 and buttress 52, the insert 82 being aligned with the slot 80. Fastener 68 is provided as a bolt 84 which receives washer 86 thereon, the bolt 84 being somewhat longer than bolt 72 so as to extend diagonally across the stacking leg 20A. Thus, the alternate embodiment 10A is fundamentally a reversal of the position of the slot and insert from that shown in FIG. 5, but like assembly 10, permits relative vertical movement ofthe tank 14A relative to the stacking legs 20A to prevent transmission of stress to the tank during filling or discharge from the tank or stacking of additional assemblies and still inhibit spreading of the legs.

Figure 7:
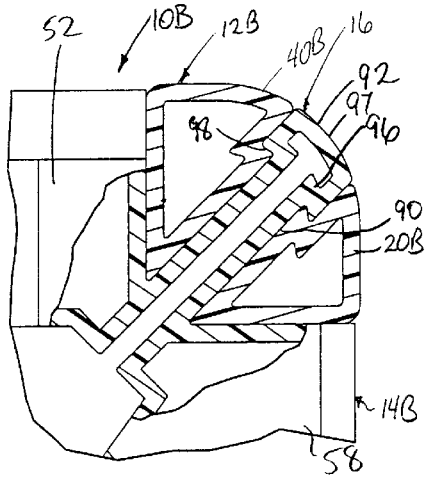
FIG. 7 is an enlarged, fragmentary vertical plan view in partial horizontal cross-section showing a second alternate embodiment of the present invention, wherein the coupler includes a fastener provided as a boss on the tank and a receiver provided as a vertically extending slot on the stacking leg complementally configured to receive the boss and thereby inhibit the leg from spreading outwardly.

The second alternate embodiment of the assembly 10B shown in FIG. 7 incorporates the coupler 16 into the base 12B and the tank 14B. In the assembly 10B, the stacking leg 20B is also provided with a slot 90 open at the top and generally diagonally oriented. However, the tank 14B is provided with a boss 92 integrally molded into the tank 14B at the junction of each buttress 52 and rim 58. The boss 92 when rotationally molded is hollow and includes a fin 94 which extends into the slot 90 and a flange 96 angled, preferably substantially perpendicularly, thereto to provide an enlarged head 97. The fin 94 thus helps to locate and maintain the position of the tank 14B by its location in slot 90, while the flange 96 engages a shoulder 98 of the stacking leg 20B in the slot 90 or the outer wall 40B of the stacking leg 20B to prevent spreading of the stacking legs under compressive loading. Thus, no additional fasteners or parts are required to maintain the relative positions of the base 12B and tank 14B once the tank 14B is in position on the base. It may be appreciated that the particular configuration and location of the boss and the slot may be varied provided that at least a portion of the stacking leg is outboard of the boss and in engagement therewith.

Both the tank 14 and the base 12 are preferably rotationally molded of thermoplastic synthetic resin such as high density polyethylene, with the insert 70, when used, held by the mold and incorporated into the stacking legs or the tank 14 when released from the mold after the resin has sufficiently cooled. After attachment of the necessary fittings and gaskets, the assembly 10 is ready for shipping, with the tank 14 positioned on the base 12 so that the sump is received in the sump passage 22. The coupler 16 interconnects the stacking legs 20 to the tank 14. The bolt 72 is threaded into the insert 70, but not so tightly that the tank 14 is prevented from shifting relative to the base 12. The tank 12 may then be filled with liquid through one of the bung openings. After filling, the assembly 10 may be transported or stored. As shown in FIG. 3, two such assemblies 10 may be stacked so that one assembly is superposed over another assembly 10 to provide a stacked combination 100, with the base 12 of one assembly 10 supported directly on the top end of the stacking legs 20 of the assembly 10 positioned therebeneath. The tank 12 may be emptied by the use of a pump connected to one of the bung openings.

What is claimed is:

1. A fluid tank assembly comprising:

a tank including a tank bottom, a tank top and a sidewall defining therein a chamber for receiving liquid; and a base including a platform wall on which the tank is supported and a multiplicity of upright elongated stacking legs located generally outboard of said sidewall, said stacking legs having a lower end and extending upwardly from said bottom wall and an upper end located above said tank top, there being a coupler connecting said tank to at least one of said stacking legs proximate the upper end.

2. A fluid tank assembly according to claim 1, wherein said tank and said base are molded of synthetic resin material.

3. A fluid tank assembly according to claim 2, wherein said stacking legs of said base extend downwardly to a bottom end located generally below said platform.

4. A fluid tank assembly according to claim 1, wherein said coupler includes a receiver on one of said stacking leg and said tank and a fastener engaging the other of said stacking leg and tank and connected to said receiver.

5. A fluid tank assembly according to claim 4, wherein said receiver includes a threaded insert and said fastener comprises a bolt.

6. A fluid tank assembly according to claim 5, wherein said insert is molded into said tank and said stacking leg includes a vertically extending slot aligned with said insert, said bolt engaging said stacking leg, passing through said slot and being threaded into said insert.

7. A fluid tank assembly according to claim 6, wherein each of said stacking legs includes a vertically extending slot and said tank includes a plurality of said inserts aligned with one of said slots, and including a plurality of said bolts positioned in said slots and engaging respective ones of said stacking legs.

8. A fluid tank assembly according to claim 5, wherein said insert is molded into said stacking leg and wherein said tank includes a vertically extending slot aligned with said insert, said bolt engaging said tank, passing through said slot and being threaded into said insert.

9. A fluid tank assembly according to claim 8, wherein said tank includes a plurality of slots and each of said stacking legs includes an insert molded therein and aligned with one of said slots, and including a plurality of said bolts position in said slots, threaded into respective ones of said inserts, and engaging said tank.

10. A fluid tank assembly according to claim 1, wherein said coupler includes a boss molded into said tank and a slot in at least one of said stacking legs receiving at least a part of said boss therein.

11. A fluid tank assembly according to claim 10, wherein said boss includes a web and a flange angularly oriented thereto, said flange engaging an outer margin of said stacking leg.

12. A fluid tank assembly according to claim 10, wherein each of said stacking legs includes a slot and said tank includes a plurality of said boss positioned in alignment with said slots.

13. A fluid tank assembly comprising:

a tank having a chamber for receiving liquid; and a base including a platform on which the tank is supported and a multiplicity of upright elongated stacking legs located generally outboard of said tank, each of said stacking legs having an upper end extending generally above said tank, at least some of said stacking legs including coupling structure adjacent their upper ends for coupling the stacking leg to the tank to permit relative vertical movement between the tank and the base but inhibit horizontal movement of the stacking leg relative to the tank.

14. A fluid tank assembly according to claim 13, wherein said tank and said base are molded of synthetic resin material.

15. A fluid tank assembly according to claim 14, wherein said stacking legs of said base extend downwardly to a bottom end located generally below said platform.

16. A fluid tank assembly according to claim 13, wherein said coupler includes a receiver on one of said stacking leg and said tank and a fastener engaging the other of said stacking leg and tank and connected to said receiver.

17. A fluid tank assembly according to claim 16, wherein said receiver includes a threaded insert and said fastener comprises a bolt.

18. A fluid tank assembly according to claim 17, wherein said insert is molded into said tank and said stacking leg includes a vertically extending slot aligned with said insert, said bolt engaging said stacking leg, passing through said slot and being threaded into said insert.

19. A fluid tank assembly according to claim 18, wherein each of said stacking legs includes a vertically extending slot and said tank includes a plurality of said inserts aligned with one of said slots, and including a plurality of said bolts positioned in said slots and engaging respective ones of said stacking legs.

20. A fluid tank assembly according to claim 16, wherein said insert is molded into said stacking leg and wherein said tank includes a vertically extending slot aligned with said insert, said bolt engaging said tank, passing through said slot and being threaded into said insert.

21. A fluid tank assembly according to claim 20, wherein said tank includes a plurality of slots and each of said stacking legs includes an insert molded therein and aligned with one of said slots, and including a plurality of said bolts position in said slots, threaded into respective ones of said inserts, and engaging said tank.

22. A fluid tank assembly according to claim 13, wherein said coupler includes a boss molded into said tank and a slot in at least one of said stacking legs receiving at least a part of said boss therein.

23. A fluid tank assembly according to claim 22, wherein said boss includes a web and a flange angularly oriented thereto, said flange engaging an outer margin of said stacking leg.

24. A fluid tank assembly according to claim 22, wherein each of said stacking legs includes a slot and said tank includes a plurality of said boss positioned in alignment with said slots.

25. In combination:

first and second fluid tank assemblies each comprising a tank having a chamber for receiving liquid and a base on which the tank is supported, each base including a multiplicity of upright elongated stacking legs located generally outboard of said tank and having an upper end extending generally above said tank, at least some of said stacking legs including coupling structure adjacent their upper ends for coupling the stacking leg to tank to permit relative vertical movement between the tank and the base, said base of said second tank assembly being directly supported on said upper ends of the stacking legs of the first tank assembly.

* * * * *